US008601991B2

(12) United States Patent
Pawl et al.

(10) Patent No.: US 8,601,991 B2
(45) Date of Patent: Dec. 10, 2013

(54) LOW PROFILE VALVE STEM SEAL IN CYLINDER HEAD

(75) Inventors: Rory S. Pawl, West Bloomfield, MI (US); Patrick L. Scheib, Cornelia, GA (US); John A. London, Cornelia, GA (US)

(73) Assignee: Freudenberg-NOK General Partnership, Plymouth, MI (US)

( * ) Notice: Subject to any disclaimer, the term of this patent is extended or adjusted under 35 U.S.C. 154(b) by 337 days.

(21) Appl. No.: 13/195,984

(22) Filed: Aug. 2, 2011

(65) Prior Publication Data

US 2013/0032118 A1 Feb. 7, 2013

(51) Int. Cl.
*F02N 3/00* (2006.01)
*F02F 11/00* (2006.01)

(52) U.S. Cl.
USPC ..... 123/188.6; 277/502

(58) Field of Classification Search
USPC ..... 123/188.6, 188.9, 188.12, 188.13; 277/502
See application file for complete search history.

(56) References Cited

U.S. PATENT DOCUMENTS

| | | | |
|---|---|---|---|
| 2,878,799 | A | 3/1959 | Brenneke |
| 4,919,090 | A | 4/1990 | Deuring et al. |
| 5,046,463 | A | 9/1991 | Worsley |
| 5,558,056 | A | 9/1996 | Sakata |
| 5,775,284 | A | 7/1998 | Kirchner et al. |
| 6,202,616 | B1 | 3/2001 | Gracyalny |
| 6,901,902 | B1 | 6/2005 | Butcher et al. |
| 6,938,877 | B2 | 9/2005 | Mc Arthy et al. |
| 7,438,036 | B2 | 10/2008 | Hesher et al. |
| RE40,764 | E | 6/2009 | Butcher et al. |

*Primary Examiner* — Noah Kamen
(74) *Attorney, Agent, or Firm* — Daniel J. Sepanik, Esq.; Harness, Dickey & Pierce, P.L.C.

(57) ABSTRACT

A valve stem seal assembly in an internal combustion engine includes a cylinder head including an aperture therein in communication with a cylinder bore and a recessed pocket surrounding the aperture. A valve guide is received in the aperture and a valve stem is received in the valve guide. A valve seal support includes a radially outwardly extending flange disposed against a surface of the cylinder head external to the recessed pocket and a cylindrical body that extends into the recessed pocket. A valve spring contacts the flange and a resilient seal is secured to the rigid valve seal support and in sealing engagement with the valve stem.

15 Claims, 3 Drawing Sheets

LOW PROFILE VALVE STEM SEAL IN CYLINDER HEAD

FIELD

The present disclosure relates to valve stem seals and more particularly, to a low profile valve stem seal.

BACKGROUND

This section provides background information related to the present disclosure which is not necessarily prior art.

Valve stem seals are known in the art. The valve stem seals are used to keep oil from being drawn into the combustion chamber or into the exhaust manifold from around the valve stem. If leakage is allowed to occur an increase in oil consumption of the vehicle and an impairment of proper engine performance as specified by manufacturers can result.

Generally speaking a valve stem seal assembly includes a rigid shell to secure a seal body on a valve stem guide, with the inside diameter of the shell engaging the outside diameter of the guide. The shell usually supports a sealing element which is centered about the valve stem in order to meter the oil that lubricates the guide inner diameter valve stem interface yet limit oil or liquid from being drawn into a combustion chamber or exhaust chamber.

Current valve stem seal designs are relatively tall which places design constraints on the cylinder head and other engine components.

SUMMARY

This section provides a general summary of the disclosure, and is not a comprehensive disclosure of its full scope or all of its features.

A low profile valve stem seal assembly is provided for use in an internal combustion engine. The valve stem seal assembly includes a cylinder head including an aperture therein in communication with a cylinder bore and a recessed pocket surrounding the aperture. A valve guide is received in the aperture and a valve stem is received in the valve guide. A valve support includes a radially outwardly extending flange disposed against a surface of the cylinder head external to the recessed pocket and a cylindrical body that extends into the recessed pocket. A valve spring seats against the flange and a resilient seal is secured to the rigid valve support and in sealing engagement with the valve stem.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
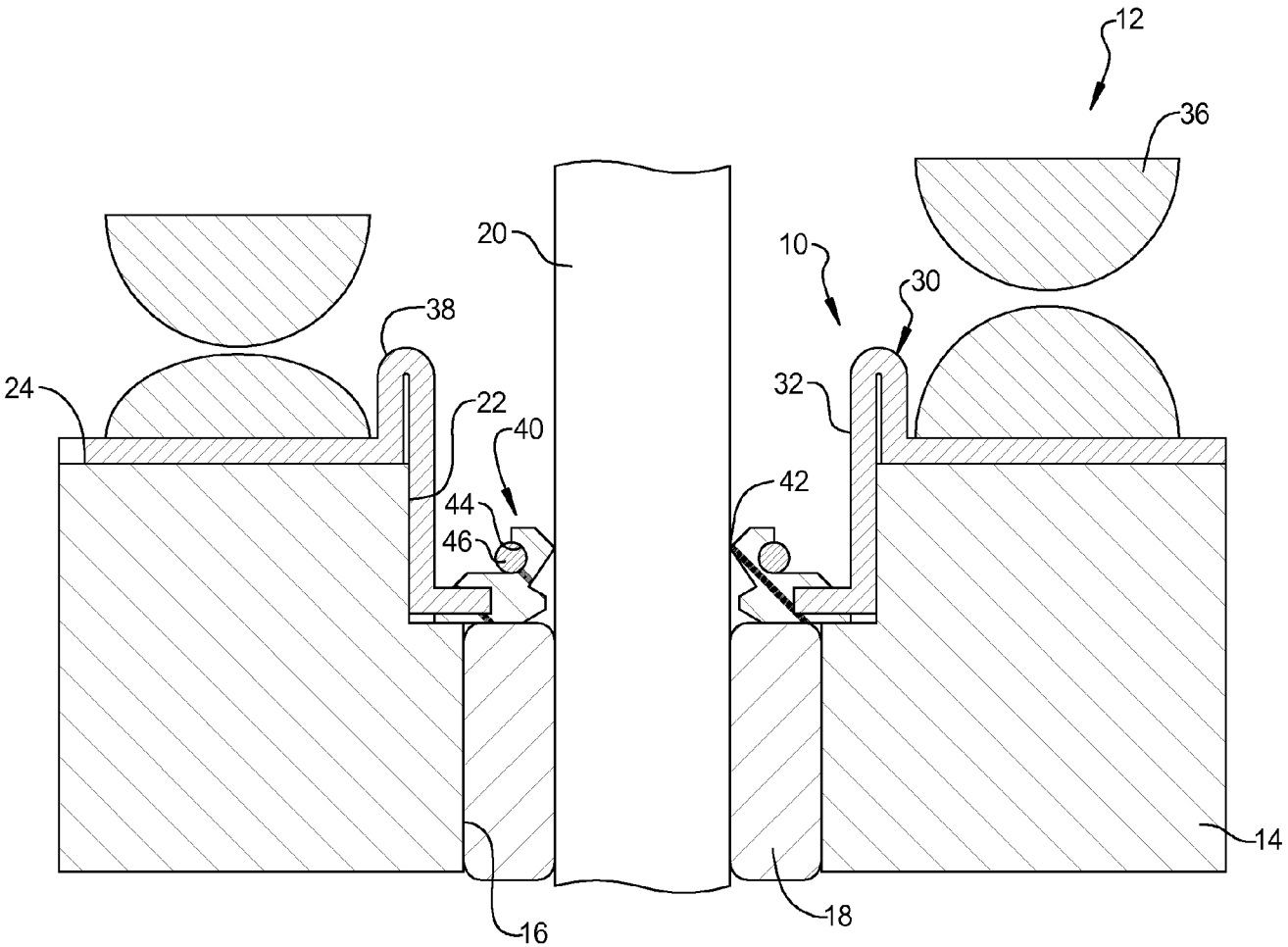
FIG. 1 shows a cross-section of a valve stem seal assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a valve stem seal assembly 10 is shown for use in an internal combustion engine 12. The internal combustion engine 12 includes a cylinder head 14 having an aperture 16 extending therethrough. A valve guide 18 is disposed in the aperture and receives a valve stem 20 that is supported by the valve guide 18. A recessed bore 22 is disposed concentric with the aperture 16 in a surface 24 of the cylinder head 14 that is opposite the cylinder of the engine block (not shown). The depth of the recessed bore 22 can vary depending upon a desired application.

The valve stem seal assembly 10 includes a seal support 30 having a generally cylindrical body portion 32 that is received the recessed bore 22 and a radially extending flange portion 34 that is external to the bore 22 and is disposed against the surface 24 of the cylinder head 14. A valve spring 36 is disposed against the flange portion 34. A spring pilot 38 can extend axially from the flange portion 34 in a direction opposite the bore 16 so as to provide a pilot for the valve spring 36. A resilient seal 40 is provided at an inboard end of the cylindrical body 32 and includes seal lip 42 that engages the valve stem 20. The resilient seal 40 can include a recessed groove 44 that receives a seal spring 46 for applying additional force against the valve stem. The shape of the seal 40 can vary in shape depending upon the application.

Figure 2:
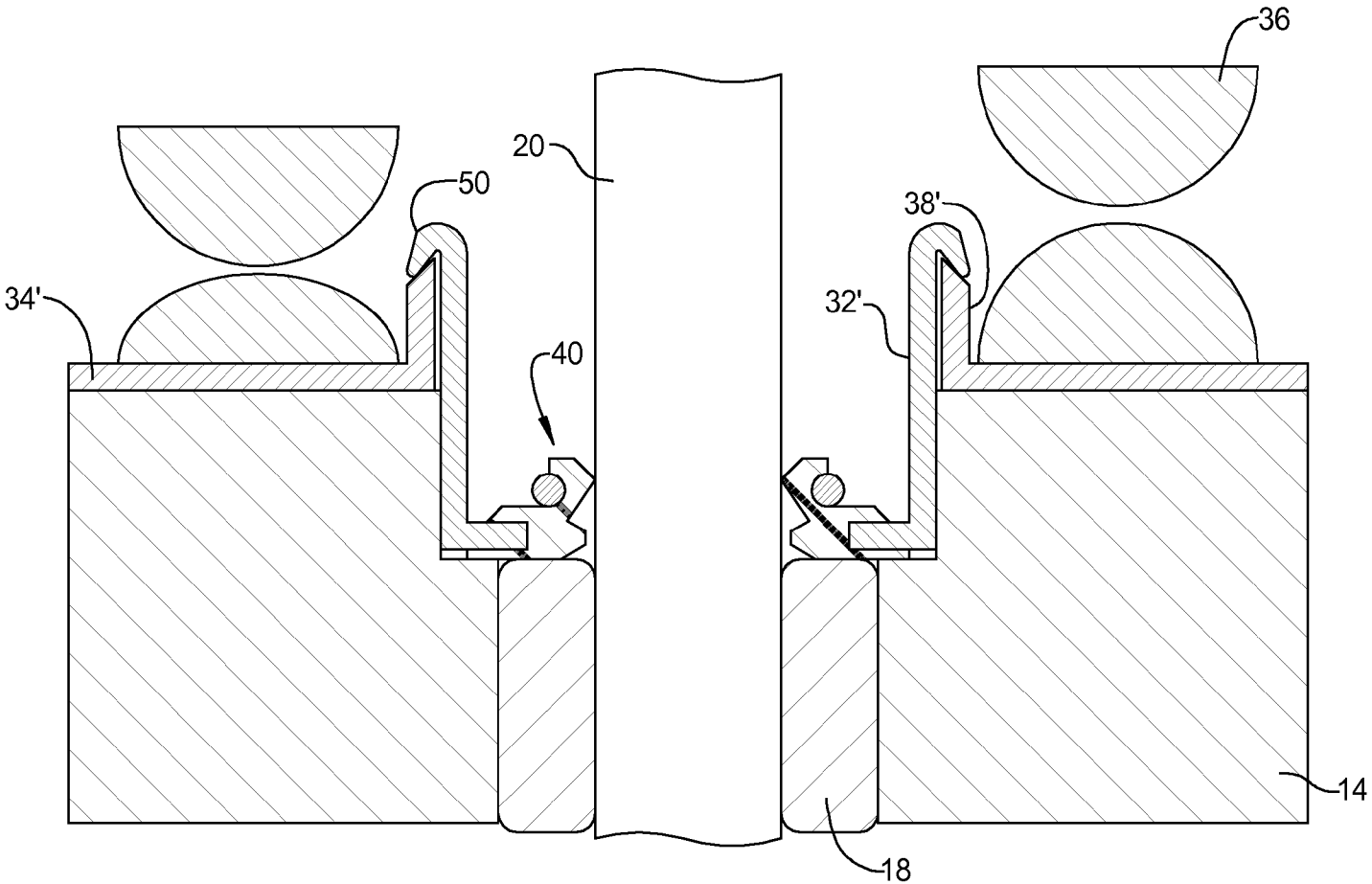
FIG. 2 shows a cross-section of the valve stem seal assembly according to a second embodiment of the present disclosure.
Figure 3:
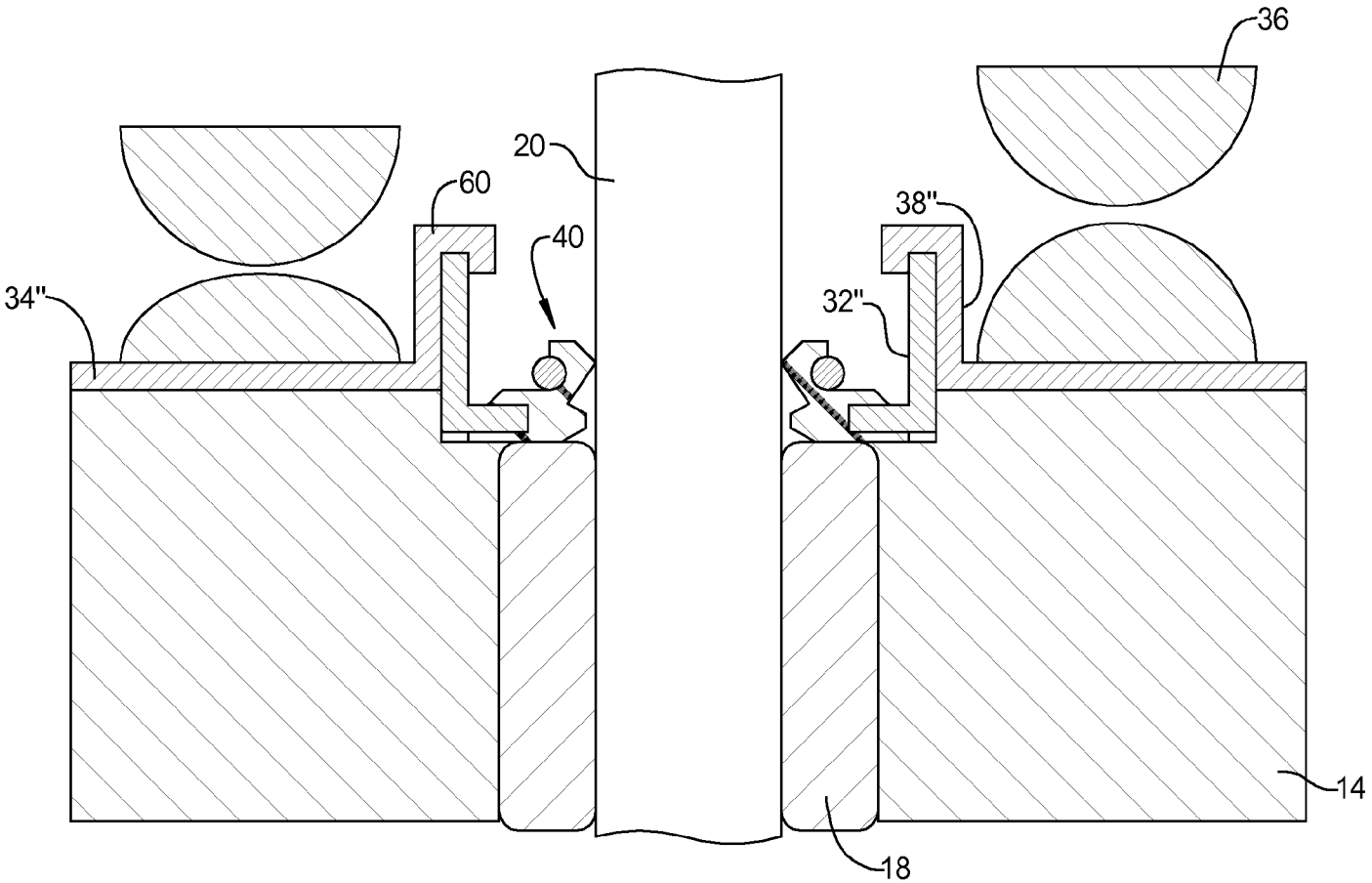
FIG. 3 shows a cross-section of the valve stem seal assembly according to a third embodiment of the present disclosure.

In the embodiment shown in FIG. 1, the cylindrical body portion 32 and the radially extending flange portion 34 are integrally formed as a unitary body 48 along with the spring pilot 38. The unitary body 48 can be formed from a metal sheet or from a tubular member or can otherwise be molded or formed using other known techniques. Alternatively, as illustrated in FIGS. 2 and 3, the radial flange portion 34 and the cylindrical body portion 32 can be formed separately. According to a first alternative embodiment as shown in FIG. 2, the cylindrical body portion can include a radially outwardly extending lip portion 50 that engages the radially extending flange portion 34' to maintain the axial alignment therebetween while allowing rotation of the radially extending flange portion 34' relative to the cylindrical body portion 32'. In this embodiment, the spring pilot 38' can be formed by the flange portion 34', the cylindrical portion 32' or both.

As a further alternative, in the embodiment as shown in FIG. 3 the radial extending flange portion 34" can include a radially inwardly extending lip 66 that engages the cylindrical body portion 32" that coaxially aligns the cylindrical body portion 32" and the radial extending flange portion 34" while allowing relative rotation therebetween. It is noted that during operation of the engine, certain harmonics can be achieved that cause rotation of the valve spring, thereby causing rotation of the radially extending flange. The embodiments of FIGS. 2 and 3 allow rotation of the radially extending flange portion 34', 34" without causing an associated rotation of the cylindrical body portion 32', 32".

With the design of the present disclosure, the valve stem steal assembly has a generally inverted configuration as compared to conventional valve stem seal assembly. This inverted configuration allows the valve stem seal assembly 10 to take a lower profile, thus allowing greater design flexibility with regard to the thickness of the cylinder head walls, as well as allowing a reduced length of the valve guide 18 thereby reducing the amount of valve guide material and the friction between the valve guide 18 and valve stem 20.

The recessed seal configuration also allows engine oil to pool inside the cylindrical body portion 32, 32', 32" above the seal 40 when the engine 12 is not in operation. Therefore, during startup of the engine 12, oil is immediately available to provide necessary lubrication between the valve stem seal 10 and valve stem 20 whereas conventional valve stem seals typically operate initially with little or no lubrication until the lubrication is properly distributed during operation of the engine.

The design of the present disclosure also provides reduced overall valve seal assembly height as only a small section is needed for the spring pilot 38 that extends from the base of the spring pocket past the top of the cylinder head surface. The present design further reduces the material needed for the valve stem seal design, thus providing lower cost. The design also provides more design freedom to place the desired thickness of the cylinder head between the intake/exhaust port in the valve train deck further up in the vertical direction to gain more wetted perimeter for the incoming or exiting mass flow to or from the cylinder.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A valve stem seal assembly in an internal combustion engine, said assembly including:

a cylinder head including an aperture therein in communication with a cylinder bore and a recessed pocket surrounding said aperture;

a valve guide received in said aperture;

a valve stem received in said valve guide;

a valve seal support having a radially outwardly extending flange disposed against a surface of said cylinder head external to said recessed pocket and a cylindrical body extending into said recessed pocket;

a valve spring seats against said flange; and a resilient seal secured to said valve seal support and in sealing engagement with said valve stem.

2. The valve stem seal assembly according to claim 1, wherein said radially outwardly extending flange and said cylindrical body are integrally formed as a unitary member.

3. The valve stem seal assembly according to claim 1, further comprising a spring pilot disposed between said radially outwardly extending flange and said cylindrical body, said spring pilot extending axially from said flange in a direction opposite said recessed pocket.

4. The valve stem seal assembly according to claim 1, wherein said flange is formed as a separate member from said cylindrical body.

5. The valve stem seal assembly according to claim 4, wherein said cylindrical body includes a radially outwardly extending portion supporting said flange.

6. The valve stem seal assembly according to claim 4, wherein said flange includes a radially inwardly extending portion supporting said cylindrical body.

7. The valve stem seal assembly according to claim 4, wherein said flange is rotatable relative to said cylindrical body.

8. The valve stem seal assembly according to claim 1, further comprising a spring member disposed in a spring recess in said resilient seal.

9. A valve stem seal assembly for use in an internal combustion engine having a cylinder head including an aperture therein in communication with a cylinder bore and a recessed pocket surrounding said aperture, a valve guide received in said aperture and a valve stem received in said valve guide, said valve stem seal assembly comprising:

a valve seal support having a cylindrical body having a first end adapted to extend into said recessed pocket, a spring pilot adapted to extend axially from said recessed pocket and a radially outwardly extending flange extending radially outward from said spring pilot and adapted to be disposed against a surface of said cylinder head external to said recessed pocket; and a resilient seal secured to said first end of said cylindrical body and adapted to be in sealing engagement with said valve stem.

10. The valve stem seal assembly according to claim 9, wherein said radially outwardly extending flange and said cylindrical body are integrally formed as a unitary member.

11. The valve stem seal assembly according to claim 9, wherein said flange is formed as a separate member from said cylindrical body.

12. The valve stem seal assembly according to claim 11, wherein said cylindrical body includes a radially outwardly extending portion supporting said flange.

13. The valve stem seal assembly according to claim 11, wherein said flange includes a radially inwardly extending portion supporting said cylindrical body.

14. The valve stem seal assembly according to claim 11, wherein said flange is rotatable relative to said cylindrical body.

15. The valve stem seal assembly according to claim 9, further comprising a spring member disposed in a spring recess in said resilient seal.

* * * * *